US007063410B2

(12) United States Patent
Slotto et al.

(10) Patent No.: US 7,063,410 B2
(45) Date of Patent: Jun. 20, 2006

(54) INK JET APPARATUS

(75) Inventors: Steven R. Slotto, Vancouver, WA (US); Brian E. Sonnichsen, Portland, OR (US)

(73) Assignee: Xerox Corporation, Stamford, CT (US)

( * ) Notice: Subject to any disclaimer, the term of this patent is extended or adjusted under 35 U.S.C. 154(b) by 214 days.

(21) Appl. No.: 10/786,371

(22) Filed: Feb. 25, 2004

(65) Prior Publication Data

US 2005/0185032 A1 Aug. 25, 2005

(51) Int. Cl.
*B41J 2/175* (2006.01)

(52) U.S. Cl. ..... 347/86; 347/85

(58) Field of Classification Search ..... 347/7, 347/85, 87, 88, 99

See application file for complete search history.

(56) References Cited

U.S. PATENT DOCUMENTS 3,822,538 A * 7/1974 Cardell ..... 57/22
4,432,005 A * 2/1984 Duffield et al. ..... 347/86
5,123,961 A * 6/1992 Yamamoto ..... 106/31.29
5,276,468 A * 1/1994 Deur et al. ..... 347/17
5,489,925 A * 2/1996 Brooks et al. ..... 347/6
5,861,903 A * 1/1999 Crawford et al. ..... 347/88
6,030,074 A * 2/2000 Barinaga ..... 347/85
6,494,630 B1 * 12/2002 Williams et al. ..... 400/175
6,588,952 B1 * 7/2003 Silverbrook et al. ... 400/124.11
6,824,241 B1 * 11/2004 Sonnichsen et al. ..... 347/20
2002/0158950 A1 * 10/2002 Altendorf ..... 347/92

FOREIGN PATENT DOCUMENTS

JP 10138506 A * 5/1998

OTHER PUBLICATIONS

Co-pending U.S. Appl. No. 10/321,240, entitled "Ink Jet Apparatus" filed on Dec. 16, 2002 by Brian E Sonnichsen et al.

* cited by examiner

*Primary Examiner*—Anh T. N. Vo

(57) ABSTRACT

A drop emitting apparatus including an ink jet printhead; a plurality of on-board ink reservoirs for supplying ink to the ink jet printhead; a plurality of remote ink containers; a plurality of ink supply conduits fluidically connected between the remote ink containers and the on-board ink reservoirs; a common air vent, connected to each one of the plurality of remote ink containers, for venting said each one of the plurality of remote ink containers as ink is supplied to the on-board ink reservoirs from the remote ink containers.

6 Claims, 6 Drawing Sheets

INK JET APPARATUS

BACKGROUND OF THE DISCLOSURE

The subject disclosure is generally directed to ink jet printing, and more particularly to ink jet printing apparatus that includes an on-board ink reservoir.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper. Some ink jet printheads employ melted solid ink.

SUMMARY

A drop emitting apparatus including an ink jet printhead; a plurality of on-board ink reservoirs for supplying ink to the ink jet printhead; a plurality of remote ink containers; a plurality of ink supply conduits fluidically connected between the remote ink containers and the on-board ink reservoirs; a common air vent, connected to each one of said plurality of remote ink containers, for venting each one of said plurality of remote ink containers as ink is supplied to the on-board ink reservoirs from said remote ink containers.

DETAILED DESCRIPTION OF THE DISCLOSURE

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
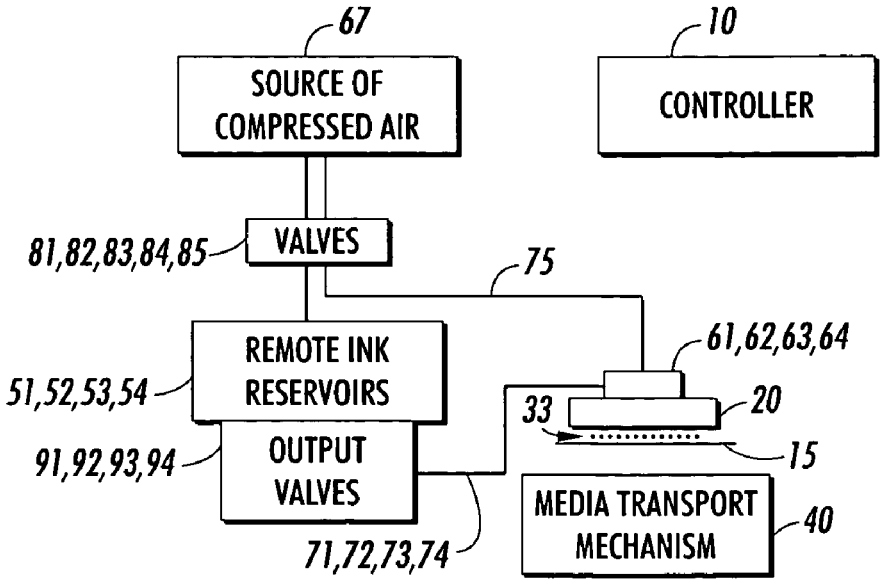
FIG. 1 is a schematic block diagram of an embodiment of an ink jet printing apparatus that includes remote ink reservoirs.
Figure 3:
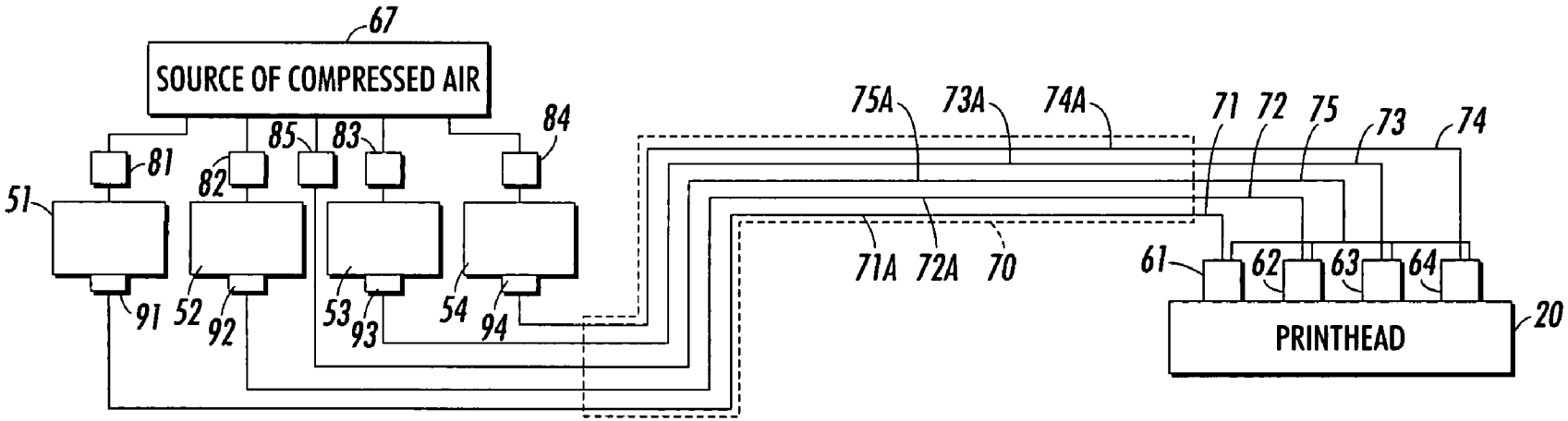
FIG. 3 is a schematic block diagram of an embodiment of ink delivery components of the ink jet printing apparatus of FIGS. 1 and 2.

FIGS. 1 and 3 are schematic block diagrams of an embodiment of an ink jet printing apparatus that includes a controller 10 and a printhead 20 that can include a plurality of drop emitting drop generators for emitting drops of ink 33 onto a print output medium 15. A print output medium transport mechanism 40 can move the print output medium relative to the printhead 20. The printhead 20 receives ink from a plurality of on-board ink reservoirs 61, 62, 63, 64 which are attached to the printhead 20. The on-board ink reservoirs 61–64 respectively receive ink from a plurality of remote ink containers 51, 52, 53, 54 via respective ink supply channels 71, 72, 73, 74. The remote ink containers 51–54 can be selectively pressurized, for example by compressed air that is provided by a source of compressed air 67 via a plurality of valves 81, 82, 83, 84. The flow of ink from the remote containers 51–54 to the on-board ink reservoirs 61–64 can be under pressure or by gravity, for example. Output valves 91, 92, 93, 94 can be provided to control the flow of ink to the on-board ink reservoirs 61–64.

The on-board ink reservoirs 61–64 can also be selectively pressurized, for example by selectively pressurizing the remote ink containers 51-54 and pressurizing an air channel 75 via a valve 85. Alternatively, the ink supply channels 71–74 can be closed, for example by closing the output valves 91–94, and the air channel 75 can be pressurized. The on-board ink reservoirs 61–64 can be pressurized to perform a cleaning or purging operation on the printhead 20, for example. The on-board ink reservoirs 61–64 and the remote ink containers 51–54 can be configured to contain melted solid ink and can be heated. The ink supply channels 71–74 and the air channel 75 can also be heated.

The on-board ink reservoirs 61-64 are vented to atmosphere during normal printing operation, for example by controlling the valve 85 to vent the air channel 75 to atmosphere. The on-board ink reservoirs 61–64 can also be vented to atmosphere during non-pressurizing transfer of ink from the remote ink containers 51–54 (i.e., when ink is transferred without pressurizing the on-board ink reservoirs 61–64).

Figure 2:
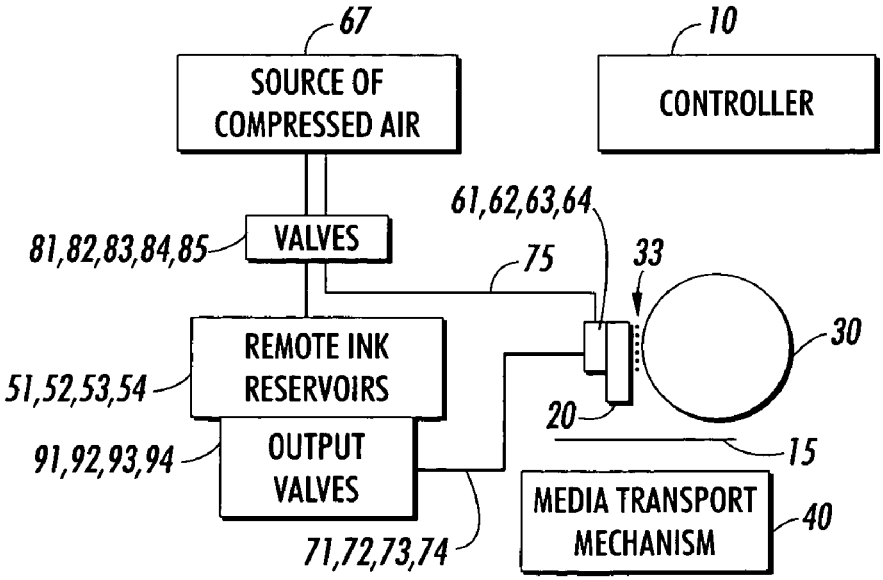
FIG. 2 is a schematic block diagram of another embodiment of an ink jet printing apparatus that includes remote ink reservoirs.

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 rollingly engages an output print medium 15 against the transfer drum 30 to cause the image printed on the transfer drum to be transferred to the print output medium 15.

As schematically depicted in FIG. 3, a portion of the ink supply channels 71–74 and the air channel 75 can be implemented as conduits 71A, 72A, 73A, 74A, 75A in a multi-conduit cable 70.

Figure 4:
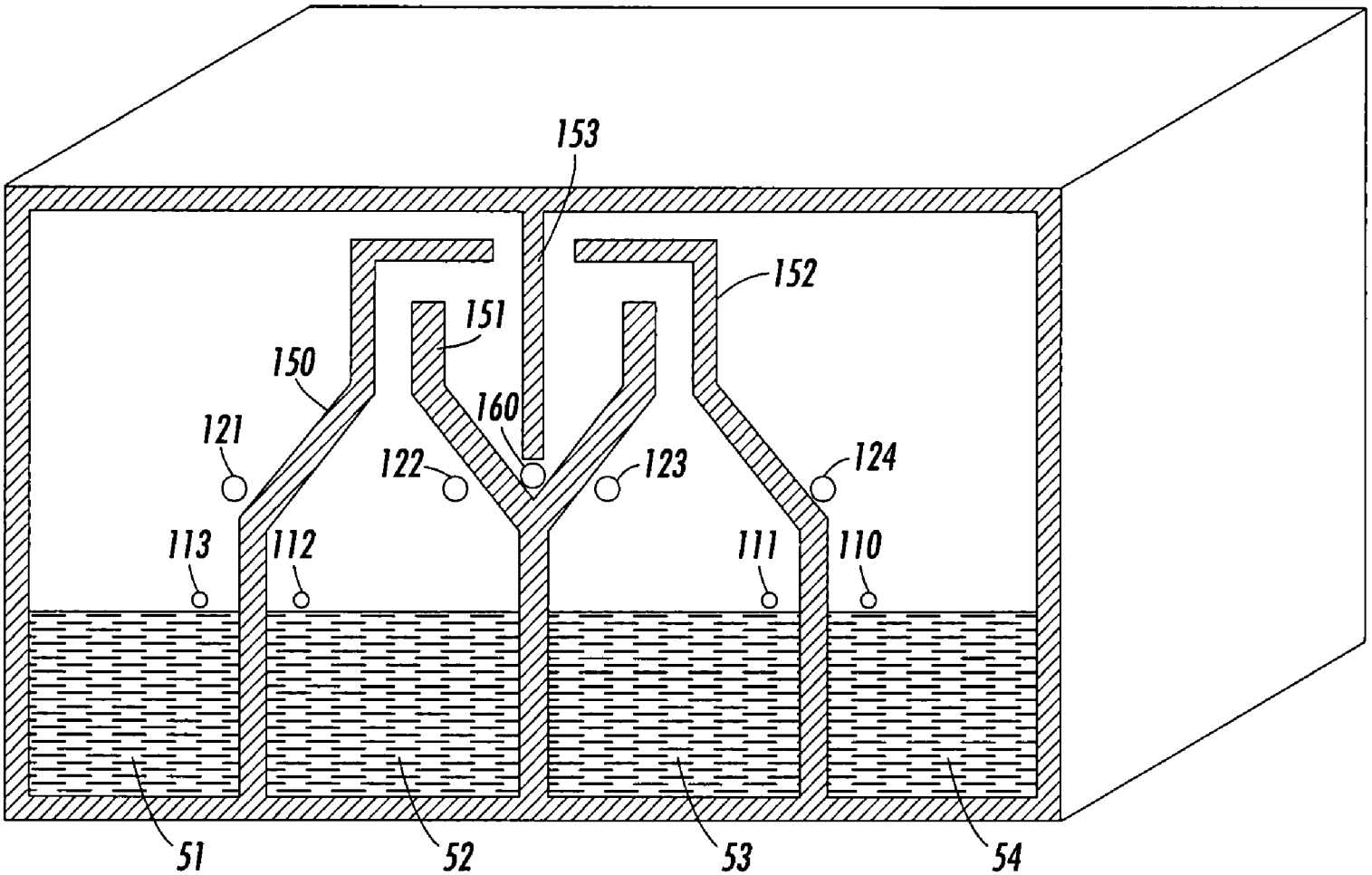
FIG. 4 is a schematic illustration of an embodiment of on-board ink reservoirs.

FIG. 4 schematically depicts the internal structure of the plurality of on-board ink reservoirs 61–64. Each of the on-board ink reservoirs 61–64 includes a pressure inlet 121–125, and a level sensor 110–113. Each of the on-board ink reservoirs 61–64 are separated from each other by vent line structures 150–153. Vent line structures 150–153 are formed in a maze type configuration, in which each vent line structure leads to a common pressure inlet vent 160.

Figure 5:
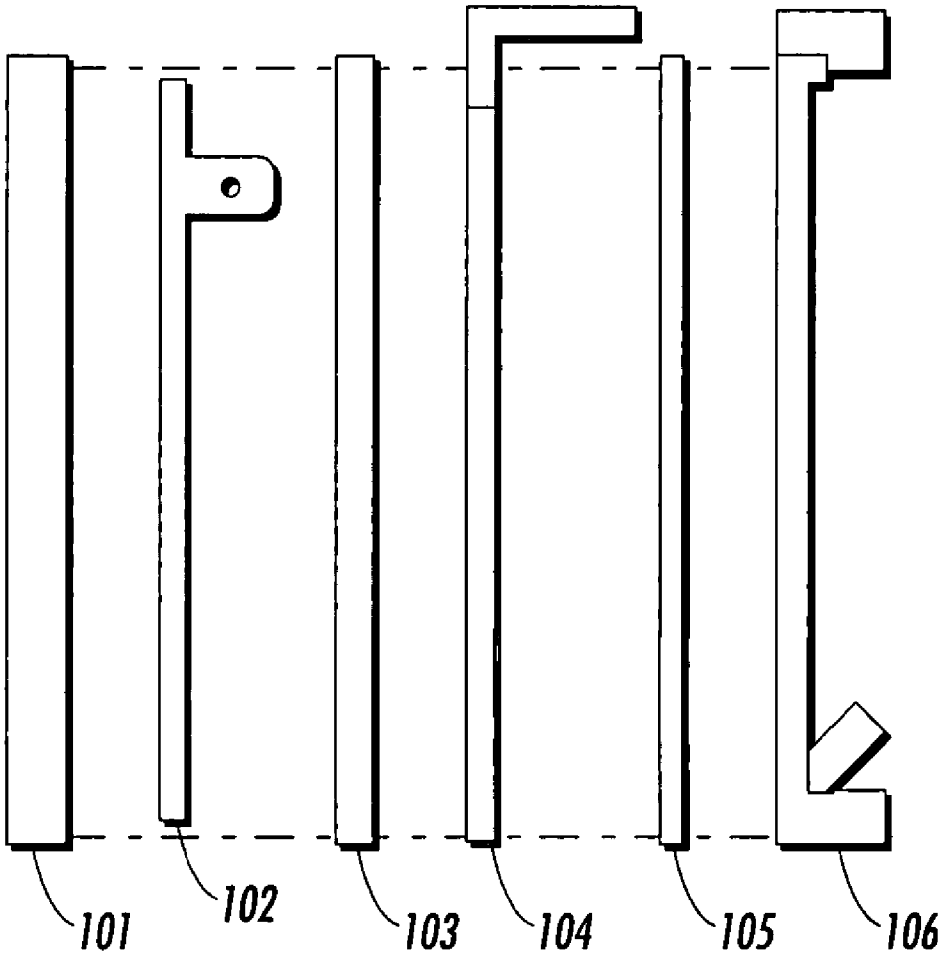
FIG. 5 illustrates a side view of an on-board ink reservoir assembly.

FIG. 5 illustrates a side view of an on-board ink reservoir assembly which includes front plate 101 and a back plate 106. Located between the front plate 101 and black plate 106 are a filter member 102, a middle plate 103, a heater member 104, and a heater plate 105.

Figure 6:
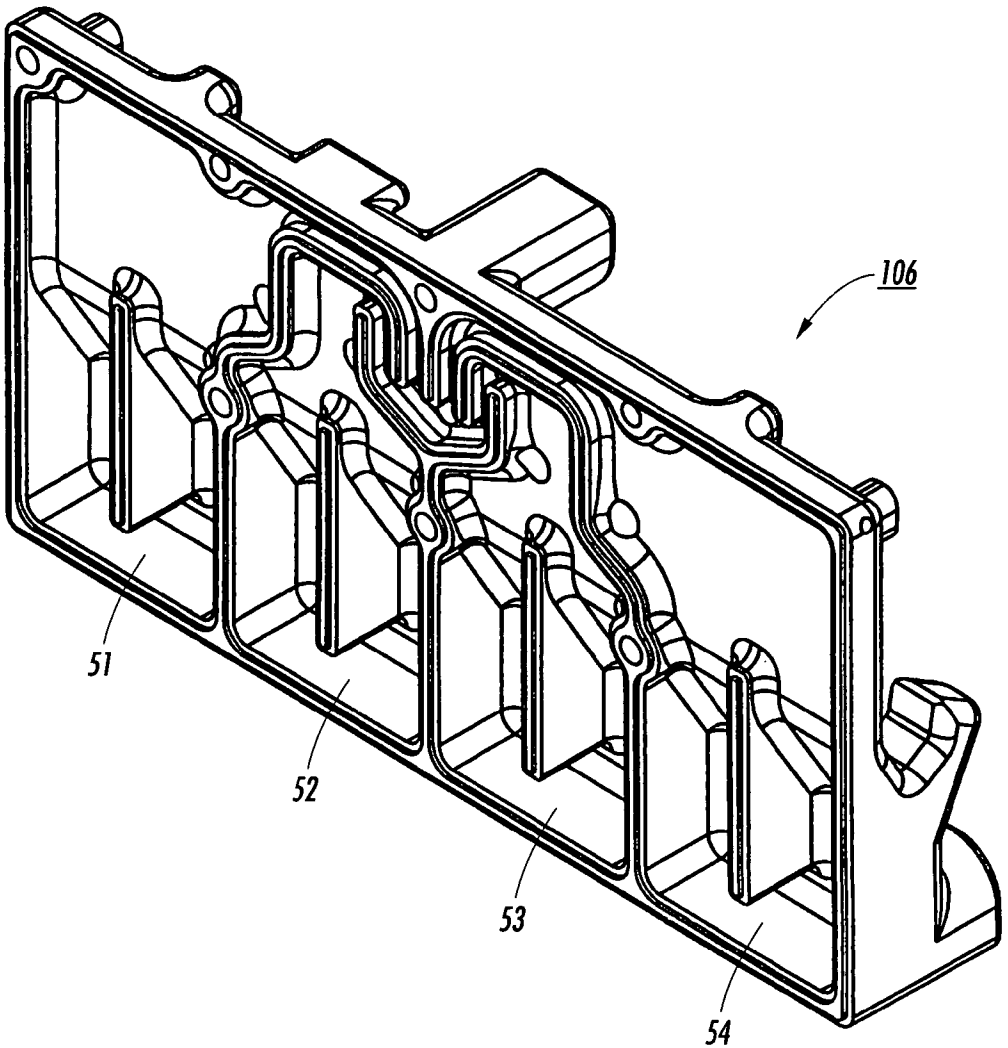
FIGS. 6 and 7 are perspective views of an embodiment of a reservoir assembly's back plate formed as an integral structure illustrating a front view of the back plate and a rear view of the back plate embodying features of the present invention.
Figure 7:
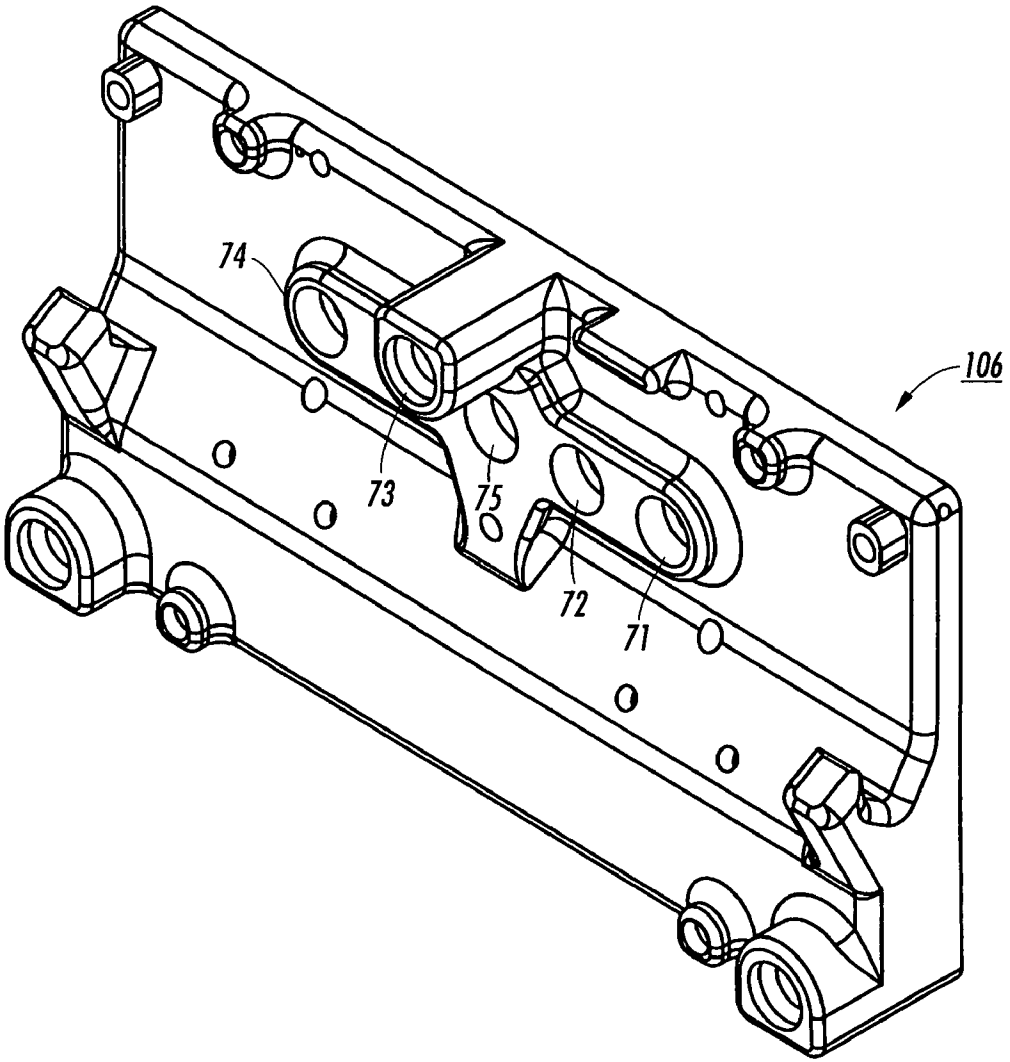

FIGS. 6 and 7 are perspective views of an embodiment of a reservoir assembly's back plate formed as an integral structure illustrating a front view of the back plate and a rear view of the back plate embodying features of the present invention. Preferably, as shown in FIG. 6, back plate 106 includes on-board ink reservoirs 51–54 which are separated from each other by vent line structures 150–153. Vent line structures 150–153 are arranged to form a maze type configuration, in which each vent line structure leads to a common pressure inlet vent 160. As shown in FIG. 7, illustrates the arrangement of the ink supply channels 71–74 and the air channel 75 which is connected to common pressure inlet vent 160. As shown in the exploded view is the reservoir back plate, this plate contains the interface for ink loading and venting of the reservoir. The five in-line holes for four colors of ink and one for venting (i.e. ink supply channels 71–74 and the air channel 75). These holes contain o-rings or equivalent gaskets to interface with a single heated multi-hose ink supply multi-conduit cable 70.

An advantageous feature of the present invention is that the on-board reservoir has one vent/purge connector common to all four colors. This reduces, by a factor of four, the number of vent lines needed for each printhead. During normal jet operation this vent is open to atmosphere, but during a purge cycle it is pressurized along with the ink feeds to purge the printhead. Further, with vent line structures 150-153 being arranged to form a maze type configuration, in which each vent line structures leads to a common pressure inlet vent 160. During tipping or sloshing, ink in the ink chambers wont mix with ink in the adjacent chamber(s). This design allows for a fairly large overfill (by comparing to the nominal ink volume) of a given ink chamber without it spilling over into the other chambers.

In recapitulation, there has been provided a drop emitting apparatus including an ink jet printhead; a plurality of on-board ink reservoirs for supplying ink to the ink jet printhead; a plurality of remote ink containers; a plurality of ink supply conduits fluidically connected between the remote ink containers and the on-board ink reservoirs; a common air vent, connected to each one of said plurality of remote ink containers, for venting each one of said plurality of remote ink containers as ink is supplied to the on-board ink reservoirs from said remote ink containers. The drop emitting apparatus further includes a plurality of ink vent lines connected to said common air vent, wherein each one of said ink vent lines is connected and associated to one of said plurality of remote ink containers. And, wherein the plurality of remote ink containers, the common air vent and the plurality of ink vent lines are formed as an integral structure. Each one of said plurality of ink vent lines are routed to said common air vent in maze type configuration. The on-board ink reservoir is ink fill and venting is accomplished through one multi-ported connection on the back. There is no need for ink fill buckets or to leave any room on the top or bottom of the reservoir for ink loading. The vent connection is common to all four colors to minimize the number of vent lines needed. Internal to the reservoir, routing of the ink and vent lines is done in such a way as to not allow ink color mixing under a fairly large range of head motion and angles. There is also an allowance for slight overfilling of ink channels without ink mixing.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus comprising:

an ink jet printhead;

a plurality of on-board ink reservoirs for supplying ink to the ink jet printhead;

a plurality of remote ink containers;

a plurality of ink supply conduits fluidically connected between the remote ink containers and the on-board ink reservoirs;

a common air vent, connected to each one of said plurality of remote ink containers, for venting said each one of said plurality of remote ink containers as ink is supplied to the on-board ink reservoirs from said remote ink containers; and a plurality of ink vent lines connected to said common air vent, wherein each one of said ink vent lines is connected and associated to one of said plurality of remote ink containers, the plurality of remote ink containers, the common air vent and the plurality of ink vent lines are formed as an integral structure wherein includes a heating structure adjacent the integral structure.

2. The drop emitting apparatus of claim 1 wherein each one of said plurality of ink vent lines are routed to said common air vent in maze type configuration to prevent mixing of inks from one of said plurality of remote ink containers to another one of said plurality of remote ink containers, if said drop omitting apparatus is tipped.

3. The drop emitting apparatus of claim 1 wherein the ink jet printhead comprises a piezoelectric ink jet printhead.

4. The drop emitting apparatus of claim 1 wherein the on-board ink reservoirs and the remote ink containers are configured to contain melted solid ink.

5. The drop emitting apparatus of claim 1 wherein the remote ink containers are selectively pressurized.

6. An apparatus for supplying ink to the ink jet printhead comprising:

an ink reservoir including a plurality of ink containers;

a plurality of ink supply conduits fluidically connected between the ink containers and the ink reservoir;

a common air vent, connected to each one of said plurality of ink containers, for venting said each one of said plurality of ink containers as ink is supplied to said ink container, the plurality of ink containers and the common air vent are formed as an integral structure wherein includes a heating structure adjacent the integral structure.

* * * * *